US009484635B2

(12) United States Patent
Poulson

(10) Patent No.: US 9,484,635 B2
(45) Date of Patent: Nov. 1, 2016

(54) WAVEGUIDE ANTENNA ASSEMBLY AND SYSTEM FOR ELECTRONIC DEVICES

(71) Applicant: Kim Poulson, Seattle, WA (US)

(72) Inventor: Kim Poulson, Seattle, WA (US)

( * ) Notice: Subject to any disclaimer, the term of this patent is extended or adjusted under 35 U.S.C. 154(b) by 147 days.

(21) Appl. No.: 14/566,348

(22) Filed: Dec. 10, 2014

(65) Prior Publication Data

US 2016/0006130 A1 Jan. 7, 2016

Related U.S. Application Data

(60) Provisional application No. 61/998,714, filed on Jul. 7, 2014.

(51) Int. Cl.
*H01Q 13/00* (2006.01)
*H01Q 13/18* (2006.01)
*H01Q 13/10* (2006.01)

(52) U.S. Cl.
CPC ..... *H01Q 13/18* (2013.01); *H01Q 13/103* (2013.01)

(58) Field of Classification Search
CPC ..... H01Q 13/206; H01Q 9/0407
USPC ..... 343/722, 745, 749, 793, 700 MS, 848
See application file for complete search history.

(56) References Cited

U.S. PATENT DOCUMENTS 2,633,492 A * 3/1953 Ring ..... H01P 1/209 333/120
4,761,654 A 8/1988 Zaghloul
5,010,348 A 4/1991 Rene et al.
5,583,524 A 12/1996 Milroy
6,118,412 A * 9/2000 Chen ..... H01P 1/161 333/137
6,198,453 B1 3/2001 Chew
146,806 A1 8/2003 Nuecther et al.
6,662,028 B1 12/2003 Hayes et al.
7,071,879 B2 7/2006 Strickland
7,164,387 B2 1/2007 Sievenpiper
(Continued)

OTHER PUBLICATIONS

Excitation of Dielectric Resonator Antennas by a Waveguide Probe: Modeling Technique and Wide-Band Design, IEEE Transactions on Antennas and Propagation, vol. 53, No. 3, Mar. 2005, p. 1028-1037.

*Primary Examiner* — Sue A Purvis
*Assistant Examiner* — Jae Kim
(74) *Attorney, Agent, or Firm* — Lynette Wylie; Apex Juris, pllc

(57) ABSTRACT

A waveguide antenna assembly and process for transceiving signals of a predetermined radio frequency range comprising at least two collaterally aligned conductive layers configured in a conformable loop so as to form an electrically isolating channel dimensionally configured for support of the waveguide modes of the predetermined frequency range, an aperture for electromagnetically transceiving the signals, wherein the aperture extends along a surface of the electrically isolating channel such that the aperture extends between the outer edge of the inner surface of the first conductive layer and the second conductive layer, a back short spaced apart from the aperture a predetermined distance equal to a resonant length of the waveguide mode wavelength so as to provide a circuit impedance between the first conductive layer and the second conductive layer for tuning the waveguide to transceive the signals, and excitation points coupled to the aperture to propagate waveguide modes within the electrically isolating channel, which is conformable to the configuration of a supported electronic device.

15 Claims, 6 Drawing Sheets

(56) References Cited

U.S. PATENT DOCUMENTS 7,821,356 B2 10/2010 Espino et al.
8,630,044 B2 1/2014 Bowers
8,730,119 B2 * 5/2014 Runyon ..... H01Q 13/0216 343/756
2007/0236402 A1 * 10/2007 Chang ..... H01P 5/222 343/776

* cited by examiner

| NAME | ANG | MAG |
|---|---|---|
| H11 XZ PLANE | 0.0000 | 6.1160 |
| H11 XY PLANE | 90.0000 | -26.9578 |

WAVEGUIDE ANTENNA ASSEMBLY AND SYSTEM FOR ELECTRONIC DEVICES

CROSS-REFERENCE TO RELATED APPLICATION

This application claims the benefit of U.S. Provisional Patent Application Ser. No. 61/998,714 filed on Jul. 7, 2014.

FIELD OF THE INVENTION

The present invention relates to antenna assemblies and systems for wireless electronic devices.

BACKGROUND OF THE INVENTION

Conventional antenna systems utilizing, for example, wire, PIFA, resonant loop, chip, patch, stripline antennas and other similar traditional antenna configurations have, in the past, limited the functionality of wireless electronic devices due to power loss resulting from inefficiencies, and associated limitations on bandwidth and gain, coupling and detuning antenna impedance/resonance and other limitations perpetuated by antenna systems conventionally employed. A particular issue with such conventional antenna assemblies arises from antenna coupling with surrounding or adjacent surfaces adversely impacting radiation pattern and input match associated with use of a conventional open body antenna. Such coupling and detuning issues impose design limitations for attaining acceptable reception, resulting from, among other things, gain and bandwidth for radio frequency signals received and transmitted to the device. As a result, design configurations for wireless electronic devices providing the requisite physical size, radiation pattern, bandwidth and gain specifications facilitating optimal functionality for electronic devices fed thereby have heretofore been restricted by such limitations. Despite attempts to address such limitations and problems, for example, by reconfiguring antenna designs, and integration of shield components to prevent coupling and detuning of signal inputs and transmissions in conventional antenna systems, a need to solve such and other limitations and issues persist.

Conventional waveguide antennas typically employing one or more slotted input arrays have, in the past, been utilized in large scale equipment, including navigation and radar systems for aircraft and backhaul transmission systems. Such large bulky waveguide antennas have not been well suited to small electronic devices.

Conventional waveguides utilized in such systems are conventionally cylindrical coaxial cables which operate in the dominant TEM mode and employ multiple apertures spaced along the waveguide guide length at particular intervals. Although such known waveguide antenna systems address issues with coupling and detuning, size and shapes limitations have precluded their adaptation to many wireless electronic devices, which are becoming increasingly more compact. Size and such other limitations of conventional waveguide geometric configurations, as well as patterns or modes associated with conventional waveguide antennas have stymied integration of waveguide antenna systems in many electronic devices, including but not limited to personal or consumer electronic devices such as, for example, mobile smartphones, smartwatches, MP3 players, wearable electronics and other such devices. The present invention as described below provides solutions and design alternatives addressing such limitations and drawbacks of the prior art.

SUMMARY OF THE INVENTION

The present invention addresses such limitations and drawback of the prior art by providing a waveguide antenna assembly and process which is conformable to an electronic device supported thereby. The waveguide antenna for transceiving signals of a predetermined radio frequency range comprising a first conductive layer configured in a conformable loop, wherein the first conductive layer has an inner surface and an outer surface, the inner surface and outer surface having an area coextensively disposed between an outer edge and an opposing inner edge; a second conductive layer configured in a conformable loop, having of an area coextensively disposed between an outer edge and an opposing inner edge, wherein the second conductive layer is collaterally aligned with the inner surface of the first conductive layer so as to electrically isolate the second conductive layer from the first conductive layer for support of waveguide modes of the predetermined frequency range; an electrically isolating channel extending between the inner surface of the first conductive layer and the second conductive layer, wherein the electrically isolating channel is dimensionally configured for transmission of the waveguide modes of the predetermined frequency range; an aperture for electromagnetically transceiving the signals, wherein the aperture is coextensively overlayed on a surface of the electrically isolating channel such that opposing sides of the aperture extend between the outer edge of the inner surface of the first conductive layer and the second conductive layer; a back short spaced back from the aperture a predetermined distance equal to a resonant length of the waveguide mode wavelength, wherein the back short provides a circuit impedance between the first conductive layer and the second conductive layer for tuning the waveguide to transceive the signals; and at least one excitation point coupled to the aperture to propagate waveguide modes within the electrically isolating channel.

In a particularly preferred embodiment of this waveguide antenna assembly, the excitation points are provided as quadrature excitation points in orthogonal orientation within the waveguide. Embodiments of the present invention further provide excitation points configured within the waveguide so as to sequentially electromagnetically shift the phase of the signals of a predetermined frequency range to cause rotational polarization. The excitation points may be amplitude and phase coupled to switch the waveguide mode pattern to steer the antenna gain pattern from a broadside to a bore sight direction.

In an alternative embodiment of this waveguide, the back short is adjustably mounted for providing a circuit impedance in the range of between one-eighth waveguide mode wavelength and one-half of a waveguide mode wavelength of the signals of the predetermined radio frequency range. In a particularly preferred embodiment, the back short is spaced back from the aperture one-quarter of the waveguide mode wavelength of the signals of the predetermined radio frequency range. In preferred embodiments of the present invention, the back short is set at a resonant length whereby the waveguide modes are nonevanescent. The waveguide antenna according to the present invention contemplates operating in signal radio frequency bandwidths of between 1 Hz and 1 THz.

As further described below, the conformability of the present waveguide's conductive layer imparts adaptability to diverse shapes and sizes and physical configurations wherein they may be fitted within, around or on variously shaped electronic devices supported thereby. Such conformability enables adaptability to underlying device package redesigns without compromising specification-compliant performance, particularly within physical confines of small and compact modern devices, comprises one of many advantages provided by the present waveguide assembly and process. Exemplary geometric configurations, as further described below, include waveguide antenna assemblies which encompass, embed or attach to an electronic device coated by a nonconductive, polymeric material.

Types of electronic device which the present invention may support are as varied as its potential configurations, and include any processor-based systems. In particular, devices the present antenna design supports include smartphones, smartwatches and other wearable technology and any devices including GPS or for digitally streaming and broadcasting signals to mobile or desk top systems, including computers and televisions.

The present invention further provides an underlying process for transceiving of data signals to and from an electronic device supported thereby through a waveguide, comprising transceiving signals of the predetermined frequency range to and from an aperture oriented in a continuous elongated loop formed between conductive layers, wherein the aperture extends into a nonconductive channel so as to electrically isolate the conductive layers to dimensionally support waveguide modes for multimodal transmission and radiation of the signals of a predetermined frequency range, providing a circuit impedance between the two conductive layers for tuning the waveguide mode resonance to form waveguide mode radiation patterns, the circuit impedance of a back short spaced back a corresponding resonant length of the waveguide mode, electromagnetically coupling the signals of a predetermined frequency range to the aperture, by coupling at least one excitation point so as to propagate waveguide mode patterns within the waveguide, and feeding the signals of the predetermined radio frequency range to and from the electronic device supported by the waveguide.

Reflecting counterpart elements of the assembly, the process further comprises sequentially electromagnetically shifting the waveguide modes to rotationally polarize antenna aperture fields. The process enables varying the amplitude and phase coupling of the excitation points to vary waveguide modes and thereby steer antenna gain patterns. A process according to the present invention may further comprise steps of encasing an electronic device within the interior of the waveguide assembly or, alternatively, embedding the waveguide antenna in a nonconductive material extending about the electronic device supported thereby.

A particularly preferred embodiment of the present invention comprises a coaxially disposed inner electrically conductive layer and an outer electrically conductive layer disposed some radial distance about the inner conductive layer, an isolating channel, nonconductive medium, interspersed therebetween and a resonant aperture on the outer electromagnetic interface coextensive with the outer surface of the isolating channel lying between collateral sides of the outer electrically conductive layer circumference and the inner electrically conductive layer outer edges. As depicted in the drawings and further specified in the detailed description of the preferred embodiments below, the waveguide comprises conformably looped collaterally, or side-by-side, oriented inner and outer electrically conductive layers form the perimeters of an open ended resonant cavity coextensively interfacing with an electromagnetic aperture formed between respective inner perimeters of the outer conductive layer and the inner conductive layer, a back short spaced apart a resonant distance from the electromagnetic aperture, wherein, and orthogonal excitation points are then strategically oriented in relation to the resonant cavity and set to an amplitude and phase to excite and polarize radio frequency signals received and transmitted through an electromagnetic aperture, thereby propagating waveguide modes. As described and claimed herein, the waveguide system and process of the present invention enables excitation and polarization for redirection of antenna radiation patterns, which is commonly known in the art and referred to herein as beam steering, with a single antenna and aperture opening.

According to the present waveguide antenna system, the inner conductive layer and the outer conductive layer are dimensionally configured to support nonevanescent waveguide modes where the mode resonator is set by spacing the back short from the aperture a resonant length of the nonevanescent waveguide mode wavelength of the signals of the predetermined radio frequency range. To thus provide nonevanescent waveguide modes, the back short sets a reference point in the waveguide resonator such that mode fields are stable along the waveguide propagation direction, being at maximum for a mode in the aperture and the excitation point sets the waveguide mode for the resultant aperture field radiation pattern established. Thus, the isolating medium occupies the waveguide space that is bounded by the outer and inner conductive layers, and back short conductors. In this medium, the waveguide mode resonates and the dominant resonant mode is established by the manner in which the resonant cavity is excited at the feed points. In alternative embodiments, the resonant cavity between aperture and back short may be tuned to variable waveguide frequencies. In a particularly preferred embodiment, the resonant longitude distance of the resonant cavity between the aperture and the back short is equal to one quarter waveguide wavelength. Components of this invention including the-back short, electronically conductive layers, excitation points and isolating medium may comprise material known in the relevant art to be functional or suitable for the stated purpose. For example, conductive layers may comprise copper, metal alloys or other well know conductors utilized in prior art antennas, excitation point may employ a printed circuit board (PCB) or microstrip coupling, direct terminals, magnetic loops, or other suitable waveguide launch mechanisms. Suitable nonconductive materials to fill the isolating medium include any matter exhibiting low dielectric losses.

As further alluded to herein, the overall or outer shape of the present waveguide antenna assembly may comprise any geometric configuration which supports aperture field formation and nonevanescent waveguide modes, as described further herein. Alternative embodiments may implement shapes that are not radially or cylindrically disposed, such as square, triangular, rectangular or nonsymmetrical or any structure, symmetric or arbitrary capable of supporting nonevanescent multimode behavior. Preferred embodiments of the present waveguide antenna are adapted to optimize the aesthetic look and functionality relating to the physical and electronic configuration of a corresponding electronic device in which it is integrated. Preferred embodiments of the present waveguide antenna assembly further comprise geometric configurations conforming to and enclosing in body, the outer surface of a wireless device.

A further preferred embodiment of the present waveguide system strategically orients the continuous aperture to avoid coupling with an electronic device and thereby detuning the antenna. In a preferred embodiment of the present invention enabling this feature, the aperture is oriented in a continuous loop contiguously channeled inside the entire outer conductor perimeter. Particularly preferred embodiments electronically couple the resonant radio frequencies received and transmitted by the present assembly with the electromagnetic surface waves native to the electronic device with which it is integrated.

Attributes and properties of the present invention provide many advantages over prior art antennas. First, the internal cavity resonator addresses problems related to detuning through coupling with the technology device, so that antenna performance is not impacted, as open resonators (PIFA, loop, etc.) do in compact technology. Second, the present waveguide antenna assembly and system is adaptable to the package surface as an efficient surface wave exciter, allowing previously unused package area (outer surface) to render useful in radiation coverage. Third, the present invention provides a multimode antenna that can be dynamically configured to redirect the antenna radiation pattern or polarization through a combination of precisely excited waveguide modes. Fourth. this invention enables radiation redirection, which is commonly referred to in the art as beam steering, by a single antenna resulting from redirection of the mode(s) formed in a single aperture by the excitation points as specified herein, providing a substantial advantage over arrays of multiple antennas required to redirect radiation patterns in the prior art. Fifth, the multimode reception of the present waveguide antenna assembly and system allows for coherent integration of the one or more excitation points that can be post processed for noise reduction. Sixth, the present waveguide antenna forms an intrinsic EMI barrier, eliminating the need for such shielding. A yet further, seventh, advantage provided by the present invention is the minimal physical size of the antenna allowing for more compact designs of modern electronic device.

Such attributes and properties provide many advantages over prior art antennas. An advantage provided by the present invention relates to adaptability of the present waveguide antenna to the exterior surface of an electronic device so as to enhance the resultant radiation pattern. For example, where the electronic device is enclosed in a conductive skin that encompasses a rotational surface (i.e., cylinder, tube, etc.), it is possible to establish surface wave propagation on that conductive skin. In addition, because the natural mode of propagation is similar in field structure to that established by the aperture field, corresponding surface waves are readily excited. Moreover, the adjacent surface of an electronic device may be designed to enhance its interaction with the waveguide antenna to improve those radiation characteristics.

Substantial advantages provided by the present waveguide antenna assembly and system derive from its compact and versatile geometric configuration. Such conformable size and shape render it adaptable for incorporation into condensed designs for wireless electronic devices which are small, sleek, ergonomic, turnkey, portable assemblies and readily secured to a relevant wearable or other surface. The present waveguide assembly and system thus delivers enhanced electronic performance within size and configuration confines imposed by such compact electronic devices.

These and other advantages and benefits heretofore inadequately addressed and unavailable in the prior art are now provided by the waveguide antenna assembly and system as described, enabled and claimed herein.

DETAILED DESCRIPTION OF PREFERRED EMBODIMENTS

Figure 1:
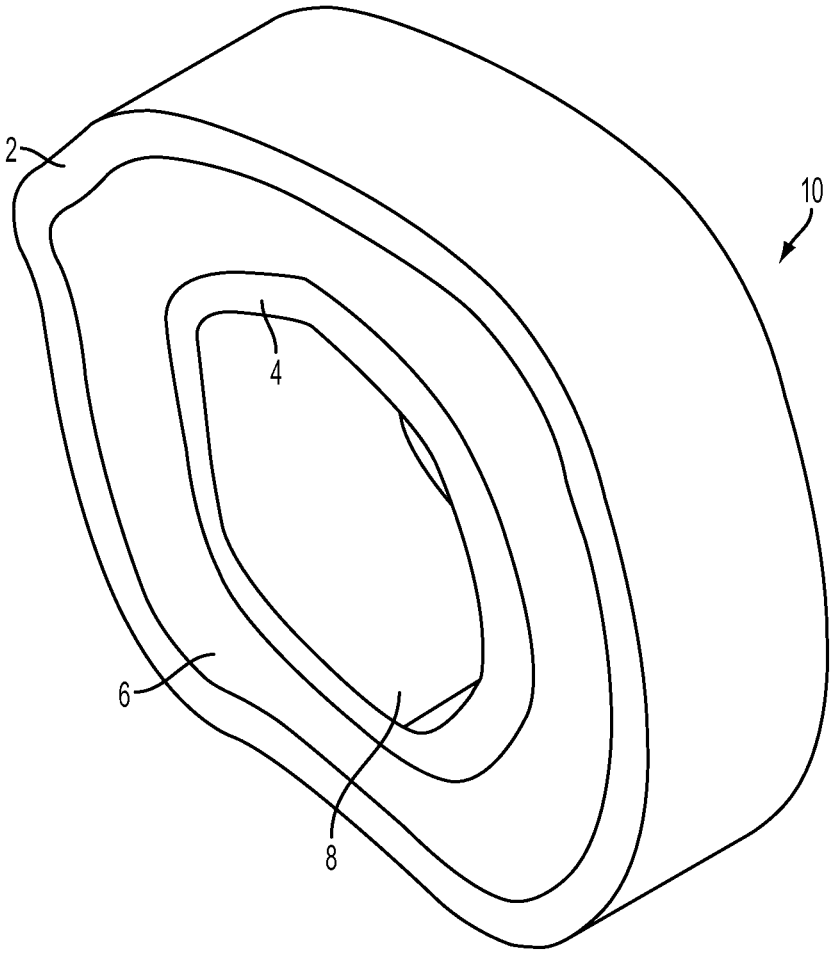
FIG. 1 is a schematic illustrating an exemplary physical configuration of the inner and outer conductive layers, and isolating medium of the present waveguide antenna.

Referring to the drawings, preferred embodiments and operational details of the present waveguide antenna assembly and system are shown and described in detail. In order to more particularly point out and clearly define the presently claimed invention, particularly spatial orientation and electromagnetic correspondence of components of the waveguide assembly, this paragraph defines terms used herein to describe and claim the present invention. To that end, dimensional arrangements are defined along Cartesian longitudinal and transverse axes. Accordingly, as referred to herein, and well known in the relevant art, a longitudinal direction is parallel to the Cartesian Z axis and the transverse direction parallel to the Cartesian X-Y axis. As illustrated, the X-axis is disposed in a horizontal transverse direction and the Y-axis is disposed in a vertical transverse direction.

The term "collateral" as used herein defines spatial orientation electrically conductive layers, claimed as a first conductive layer and as a second conductive layer, to comprise side-by-side alignment not limited to a particular or precise parallel, longitudinal or transverse alignment. The collaterally oriented conductive layers are oriented to provide an electrically isolating channel spatially dimensioned to support waveguide modes, which are characterized by corresponding patterns orthogonally depicted along Cartesian axes such as graphically shown in FIG. 3-6A and in the respective detailed descriptions thereof. The term "back short" is used herein to refer to the physical device that presents the terminating waveguide circuit impedance to the waveguide resonator and this can be formed using any mechanical or electrically controlled feature that presents the proper terminating impedance so that a resonant waveguide mode is established in the waveguide. In the preferred embodiment(s) of the present invention, this circuit impedance is a conductive short between the first and second conductive surfaces.

Illustrating one of innumerable alternative conformable physical configurations and profiles the present waveguide antenna may embody, FIG. 1 exemplifies one irregularly configured preferred embodiment of the present invention. The latter structure employs a coaxial waveguide 10 comprising an outer, or first, conductive layer 2 and a collateral inner, or second, conductive layer 4 separated by an isolating channel 6 dimensioned to support nonevanescent waveguide modes. Electrically isolating channel 6 may comprise any dielectric or nonconductive medium, and preferably comprises a low loss dielectric material with high permeability, such as, for example, $Ba_2T_{19}O_{29}$ or $Zr_2TiO_4$. Alternatively, an isolating medium may comprise any suitable low loss material, including for example, air, a vacuum, a dielectric substrate, or a ceramic substrate.

As particularly pointed out in FIG. 1, waveguide antenna 10 is conformable to fit about an electronic device (not shown) housed within a hollow or open core 8 formed inside of inner conductive layer 4. Such internal housing of an electronic device within open cavity 8 of waveguide antenna 10 of this preferred embodiment of the present invention, provides multiple advantages. First, the conformable, compact assembly is spatially efficient and may be adapted to constrained, variably configured spaces. Second, nesting an electronic device within waveguide antenna 10 provides a durable, protective shield about the nested electronic device thereby preventing damage from impacts, and wear and tear. Moreover, thus positioning an electronic device within a hollow or open cavity as shown in FIG. 1 overcomes performance problems, such as, detuning, power attenuation, and gain loss issues common to conventional antenna systems and connected electronic devices are juxtapositioned in close proximity. In contrast to requisite redesigns of known antennas in order to comply with relevant specifications of new device designs commonly reducing its size and changing the overall profile and configuration, the waveguide antenna of the present invention may be readily adapted without comparable redesigning. The present waveguide antenna's resistance to performance impediments and concomitant conformability to package redesigns of electronic devices provides substantial improvements over prior art antenna configurations.

Figure 2:
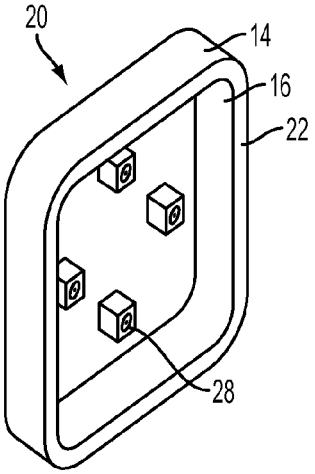
FIG. 2 is a schematic illustrating a perspective view of the back of a particularly preferred embodiment of the assembled waveguide antenna assembly according to the present invention.
Figure 2A:
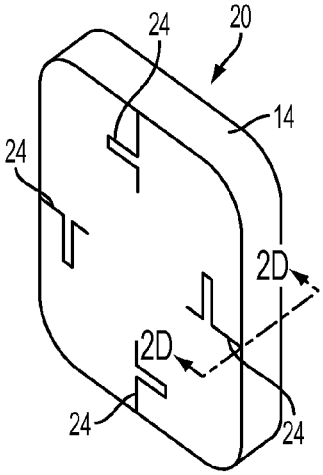
FIG. 2A is a schematic illustrating perspective view of the front of a particularly preferred embodiment of the assembled waveguide antenna assembly according to the present invention.
Figure 2B:
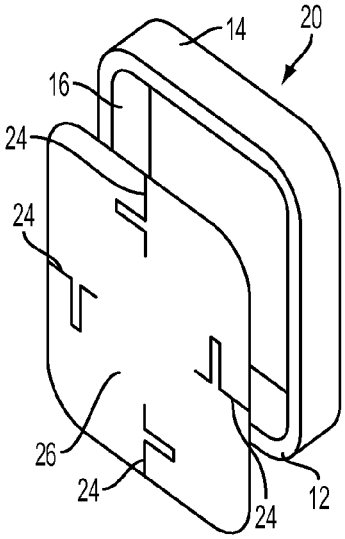
FIG. 2B is a schematic illustrating a perspective view of the front of a particularly preferred embodiment of the disassembled waveguide antenna assembly according to the present invention.
Figure 2C:
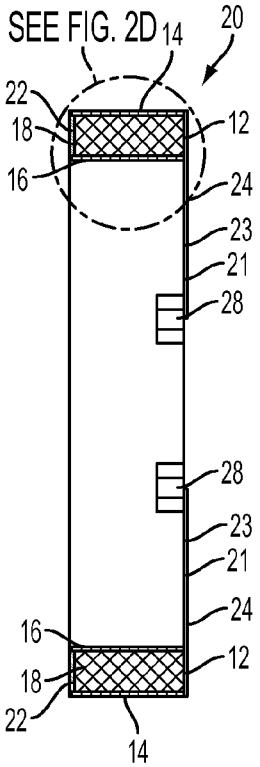
FIG. 2C is a schematic illustrating a cross sectional view along line 2D-2D of FIG. 2.
Figure 2D:
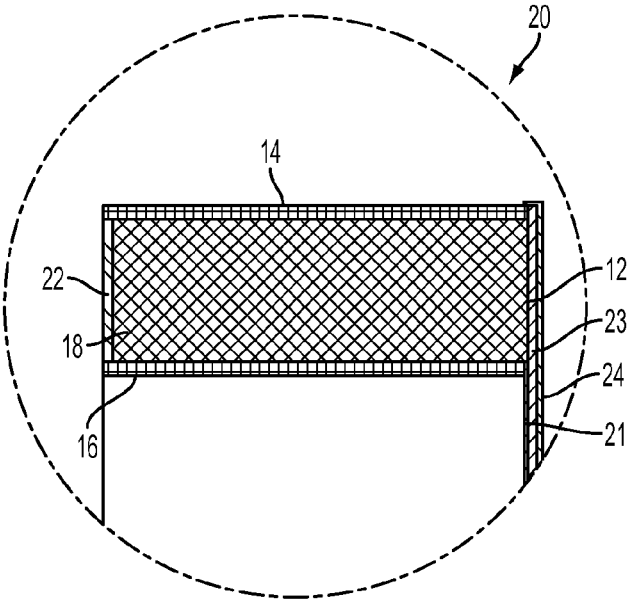
FIG. 2D is a schematic illustrating a close up view of the circled portion of FIG. 2C labeled SEE 2D.

FIG. 2-2D illustrate a preferred embodiment of the present waveguide antenna assembly 20 comprising a generally square configuration particularly designed for use in the many electronic devices employing GPS. FIG. 2 shows a perspective view from the back of the waveguide antenna assembly 20 showing connectors 28 for feeding data signals to an electronic device through techniques well known in the art. FIG. 2A depicts a frontal perspective view of waveguide assembly 20 showing orientation of excitation points 24 on microstrip PCA 26, when assembled to cover aperture 12, which electromagnetically transceives signals of a predetermined frequency range through microstrip PCA 26. FIG. 2B shows microstrip PCA 26 disassembled from the waveguide antenna assembly 20 to reveal orientation of aperture 12 relative to quadrature orthogonal excitation points 24.

Now referring to FIG. 2B-2D, aperture 12 opens into isolating channel 18 providing an isolating cavity resonator for transmission of waveguide modes from which the impedance of back short 22 is set in connection with quadrature excitation points 24 so as to form nonevanescent waveguide modes. FIGS. 2C and 2D are cross-sectional views of the particularly preferred embodiment of FIG. 2-FIG. 2B showing a cutaway view taken along line 2D-2D. FIG. 2D provides an exploded view of the area circled in FIG. 2C more clearly depicting the geometric configuration and relative orientation of aspects enabling the electromagnetic synchrony of the present waveguide antenna. As shown in FIGS. 2C and 2D cross sectional views of outer, or first, conductive layer 14 and inner, or second, conductive layer 16 are separated and thereby isolated by electrically isolating channel 18, which may comprise any dielectric. Electrically isolating channel 18 opens into aperture 12, which electromagnetically forms aperture fields of the signals of a predetermined radio frequency range through electrical coupling with excitation points 24 that is part of the microstrip PCA 26 with dielectric substrate 23 and reference ground plane 21 and back short 22, as described below. Aperture 12 is spaced a resonant one quarter waveguide mode wavelength of the corresponding signals of the predetermined radio frequency range from back short 22, Back short 22 provides a circuit impedance between the first conductive layer and the second conductive layer whereby the waveguide is tuned to the signals of a predetermined frequency range.

In the particularly preferred embodiment shown in FIG. 2-2D, each excitation point 24 is individually controlled by dynamic amplitude and phase positioning resulting in waveguide modes which are preferably nonevanescent. Excitation points 24 are phased to establish orthogonal modes which rotate aperture fields either clockwise or counter clockwise. Thus, quadrature excitation points 24 are amplitude and phase coupled so as to alter waveguide modes, thereby steering antenna gain pattern of the radio frequency signals of a predetermined wavelength. As detailed in FIG. 3-6A and respective description thereof, adjusting amplitude and phase rotates the aperture field about a symmetrical longitudinal axis to dynamically control the radiation polarization orientation to a horizontal, vertical or any angle therebetween.

Figure 3:
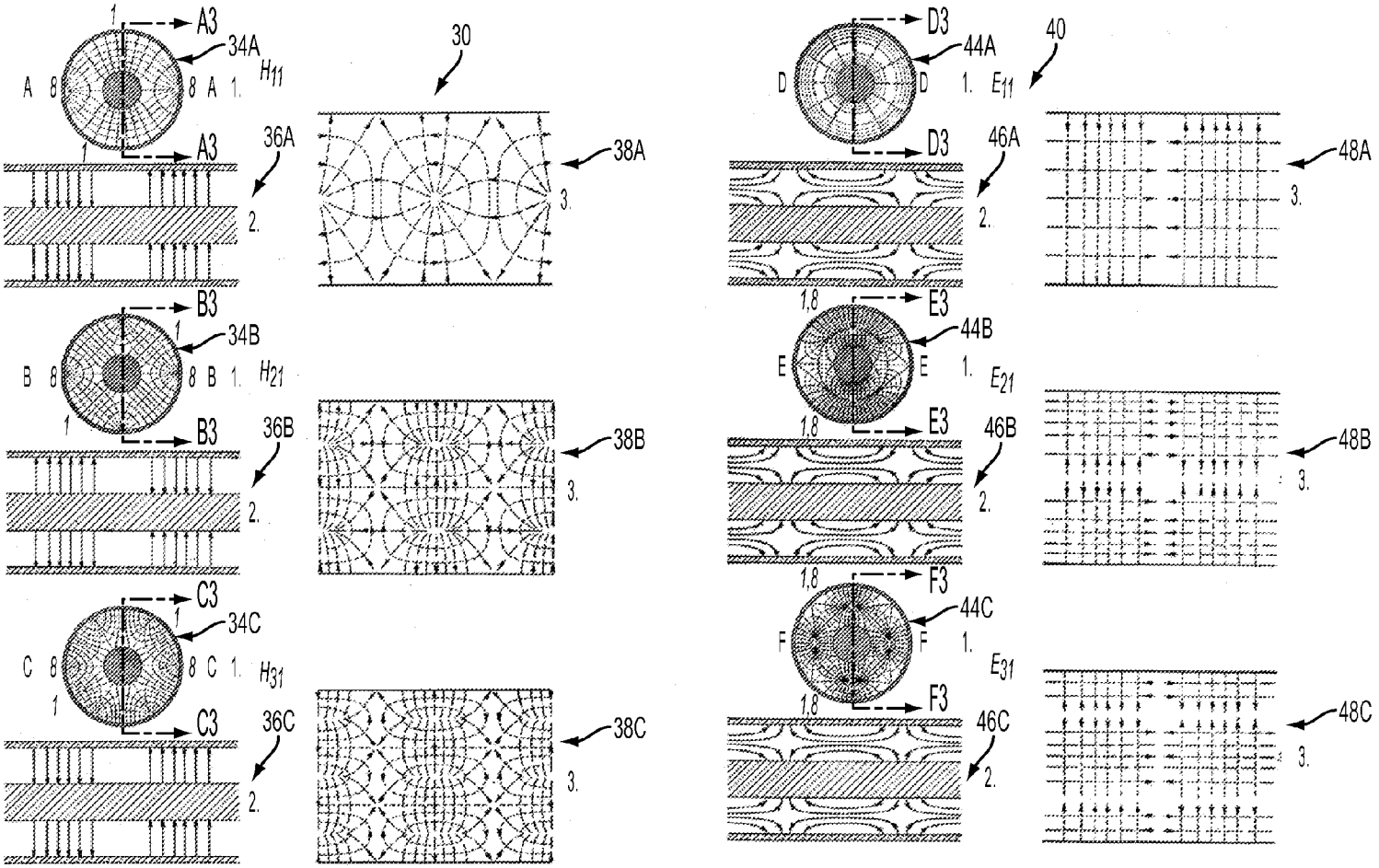
FIG. 3 is a graphic representation of radially symmetric E and H waveguide mode field lines deployable in the waveguide antenna assembly according to the present invention.

Exemplary modes established by arranging field excitations to align with the mode's field pattern are graphically represented in FIG. 3. Skilled artisans will further recognize the modes graphically shown in FIG. 3 depict a static phase relationship, as utilized in the waveguide of the present invention, wherein excitation points generate field distribution lines forming the illustrated mode patterns. As marked to the right of the respective planes of waveguide mode patterns in FIG. 3, appropriate order modes are marked, as follows: 1. cross sectional view, 2. longitudinal view, and 3. surface view along a coaxial waveguide from Cartesian axes as defined above and shown in the planes identified by the X, Y, and Z axes as shown in the drawings and referred to herein. Now referring to FIG. 3, H modes 30 are shown in the left column and E mode patterns 40 are shown on the right column. In particular, H order waveguide mode transverse magnetic field lines 34A, 34B, and 34C respectively depict $H_{11}$, $H_{21}$ and $H_{31}$ order modes cut along a plane transverse to the direction of propagation. Longitudinal lines 36A, 36B, and 36C depict the same mode patterns for $H_{11}$, $H_{21}$ and $H_{31}$ order modes cut along longitudinal planes corresponding to respective lines A3-A3, B3-B3, C3-C3 in the direction of propagation. Surface patterns 38A, 38B and 38C depict views from points A/A, B/B. and C/C counterpart perspectives of E order waveguide modes 40 field distribution lines which may be harnessed in the waveguide of the present invention are graphically depicted on the right half of FIG. 3. In particular, transverse magnetic field lines 44A, 44B, and 44C depict the relevant mode patterns transverse to the direction of propagation for $E_{11}$, $E_{21}$, and $E_{31}$ order modes respectively while 46A, 46B and 46C illustrate respective longitudinal pattern cut along lines D3-D3, E3-E3, and F3-F3, and patterns 48A, 48B, and 48C depict patterns from points D/D, E/E, and F/F respectively. Modes within the scope of the present invention include, but are not limited to, those shown in FIG. 3, which are exemplary waveguide mode patterns.

Although not included in FIG. 3, it will be apparent to persons skilled in the art that TEM is supported by the present waveguide assembly. That is, by strategically orienting positive voltage terminals on an electrically conductive layer, which may be inner or outer layers if a coaxial waveguide, relative to diametrically opposing excitation point, resultant excitation electric field strongly couples to the TEM mode, rejecting modes that are not field aligned. In contrast to radially symmetric TEM modes utilized in conventional antenna systems, the strategic orientation and amplitude/phase coordination provided by application of evanescent mode forms as the primary aperture field distribution provides substantial advantages. To demonstrate the dynamic correspondence providing such advantages, the following calculations will make apparent to persons skilled in the relevant art the electromagnetic rotation providing the phase shifting enabled by the present invention.

As well known in the art, the waveguide mode with the lowest cutoff frequency is the basic mode of the waveguide, and its cutoff frequency is the waveguide cutoff frequency. Accordingly, the cutoff wavelength for the E and H modes are:

$$\lambda_cE \approx 2(a-b)/n, E_{mn} \text{ modes}, m=0,1, \ldots n>0 \quad (1)$$

$$\lambda_cH \approx \pi(a+b)/m, H_{m1} \text{ modes}, m=1,2, \quad (2)$$

where a and b are the radial symmetric waveguide inner and outer conductor respective radii. Examination of the guide cutoff wave length(s), show that for large radius and small conductor separation, the probable set of modes is only the $H_{m1}$. Furthermore, those $H_{m1}$ modes can be excited by selectively placing excitation points rotationally at:

$$(\pi(i-1))/m, i=1,2, \ldots m+1$$

The present waveguide antenna system uses this arrangement to selectively excite the radially symmetric TEM, or the higher order asymmetric $H_{m1}$ modes.

Figure 4:
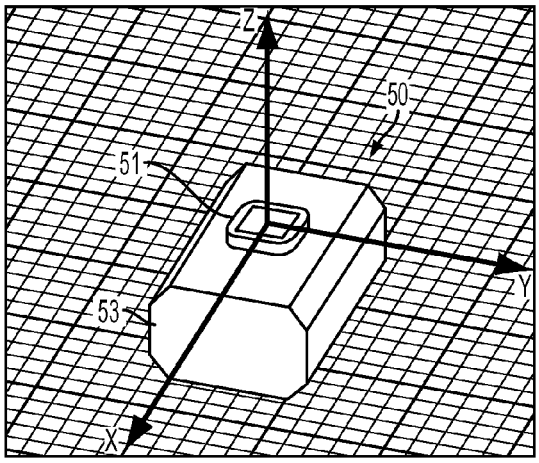
FIG. 4 is a schematic of a particularly preferred embodiment of the present invention.

FIG. 4 depicts a particularly preferred embodiment of the present waveguide antenna assembly, contemplated as a deployable GPS antenna 50 for small wearable electronic devices, such as a smart watch. The overall geometric configuration of GPS antenna 51 is generally a square measuring 25 mm×25 mm×5 mm high and placed on the body wrist 53. This embodiment sets excitation points, counterparts of which are shown in FIG. 2, with equal amplitudes and sequentially phase shifts each by 90 degrees whereby right hand polarization, such as graphically depicted in FIG. 5, is exhibited.

Figure 4A:
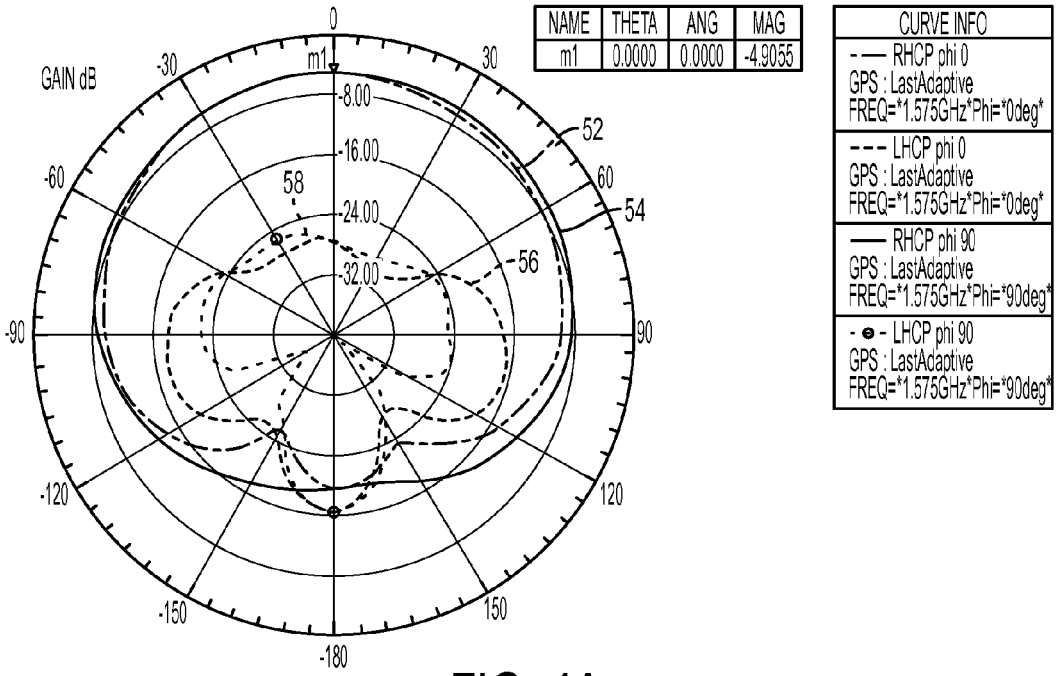
FIG. 4A is a graphic representation of simulated principal plane directivity, gain and polarization isolation patterns for the waveguide antenna assembly of the present invention applied to a wearable GPS of a preferred embodiment.

Now referring to FIG. 4A, a graph depicting the radiation pattern conveys how multimode properties of the present waveguide antennae may be implemented to control, or shift, the radiation pattern. In particular, by exciting orthogonal H modes in quadrature phase, the radiation pattern will form an Omni Right Hand Circular Polarization (RHCP) pattern graphed by dashed and dotted line 52 and solid line 54 and suppress the Left Hand Circular Polarization (LHCP) graphed by dotted line 56 and broken dashed and dotted line 58, and thereby optimize GPS signal reception. As used herein, quadrature phase refers to: excitation of the feeds by sequentially shifting each feed phase by 90 degrees relative to the feed before with equal amplitudes.

Figure 5:
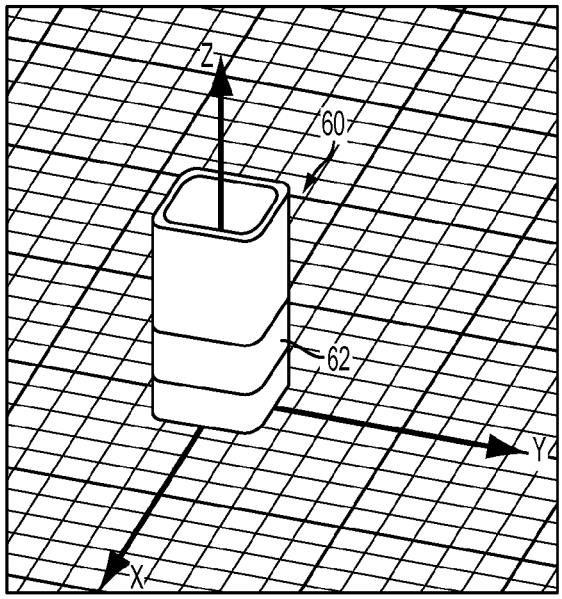
FIG. 5 is a schematic of a preferred embodiment of the waveguide assembly and system according to the present invention embedded in an acrylic covered conductive tube of a generally square shape along a transverse axis.

Referring to FIG. 5, an alternative preferred embodiment of the present invention is provided in a conductive tube 60 covered by an acrylic or other low loss dielectric wherein a multimode coaxial waveguide antenna 62 is embedded which houses an electronic device. Such a nonconductive or low loss material could comprise, for example, a polymeric material such as an acrylic, an epoxy, a phenolic, baked glass, or ceramic compound.

Figure 5A:
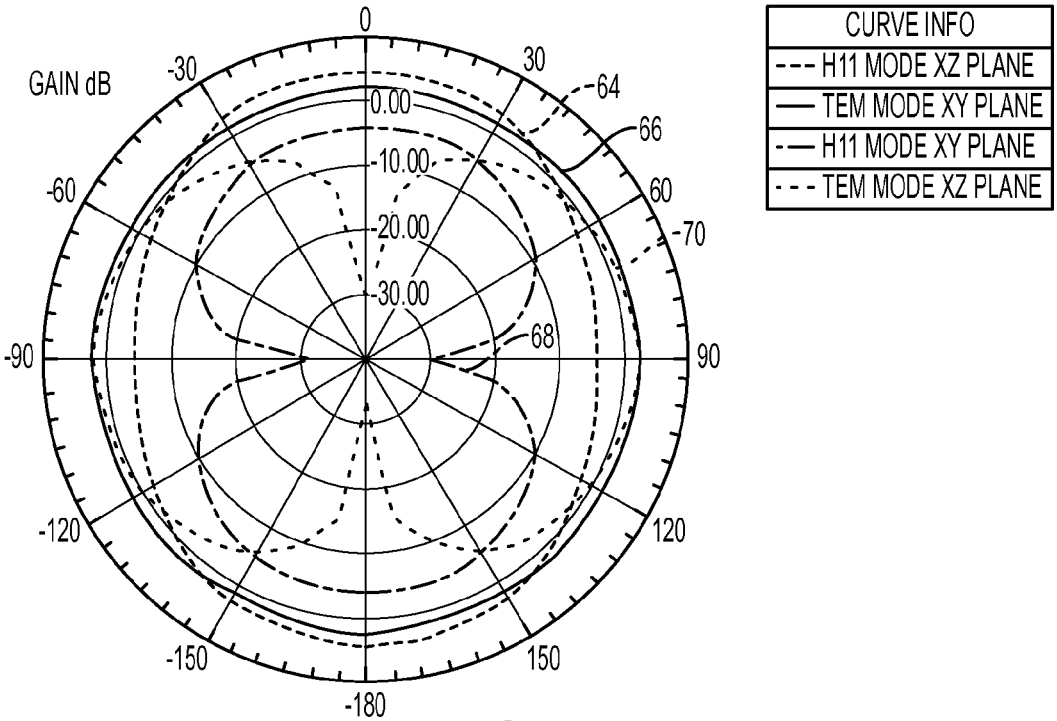
FIG. 5A is a graphic representation of simulated principal plane directivity and gain patterns for a TEM/$H_{11}$ mode switched waveguide antenna assembly of the present invention.

FIG. 5A provides a graphic representation of simulated principal plane directivity and gain patterns for a TEM/$H_{11}$ mode switched waveguide antenna assembly of the present invention. The graphic data shown in FIG. 5A demonstrates antenna gain patterns relating to excitation switching, i.e., suppression or enhancement thereof, between the TEM and $H_{11}$ modes whereby mode propagation is controlled, that determines the antenna radiation in a bore sight direction along the XZ plane, or along a broadside direction along the YZ plane. Thus, the excitation points may be manipulated to switch from a bore sight to broadside directions or eliminate interference from either direction, which is otherwise known in the art and referred to herein as beam steering. In the latter embodiment, the radiation patterns in the generally square configuration shown in FIG. 5A graphically depict improved gain provided by stable excitation of nonevanescent $H_{11}$/TEM patterns graphically depicted, along the XZ plane of FIG. 5, as dashed line 64 and dotted line 70, respectively, and as dashed and dotted line 68 and solid line 66 along the XY plane.

Figure 6:
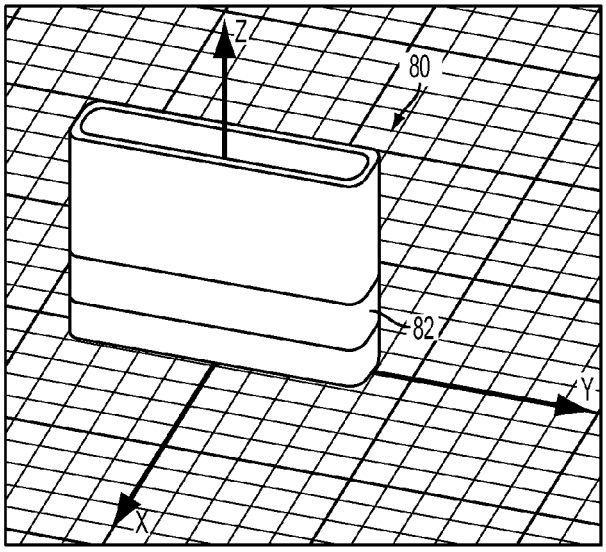
FIG. 6 is a schematic of a preferred embodiment of the waveguide assembly and system according to the present invention embedded in an acrylic covered conductive tube of a generally rectangular shape.
Figure 6A:
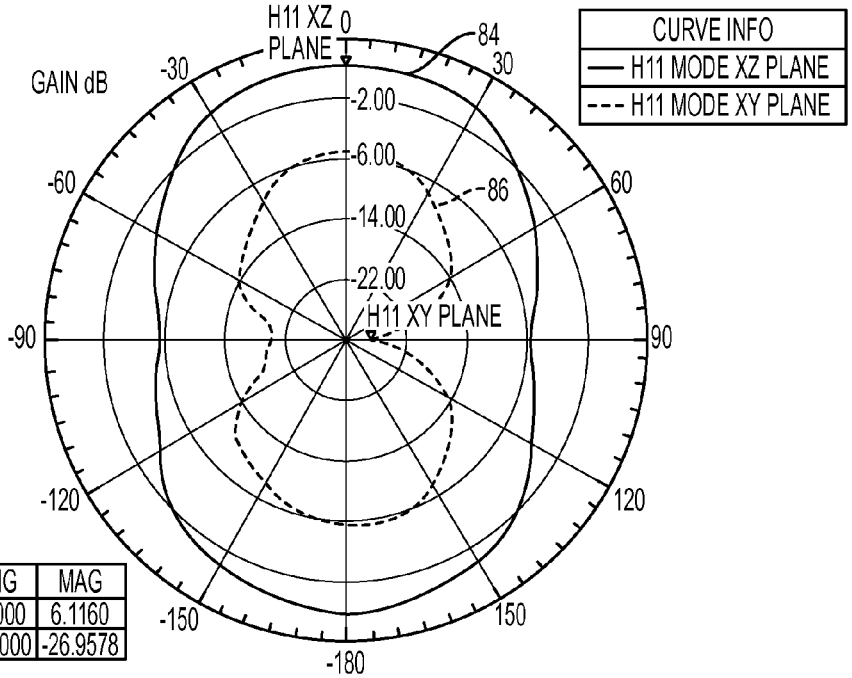
FIG. 6A is a graphic representation of simulated principal plane directivity and gain patterns for a fixed $H_{11}$ mode waveguide antenna assembly of the present invention.

FIG. 6 illustrates a further preferred embodiment employing a generally rectangular configuration 80 of the present invention to further exemplify the flexibility of the parameters of potential embodiments of the present invention. In this embodiment, antenna 82 is scaled approximately three times in the Y dimension and half the X dimension (75 mm×12 mm vs 25 mm×25 mm). All other parameters remain the same as in FIG. 5. FIG. 6A provides a graphic representation of simulated principal plane directivity and gain patterns for a $H_{11}$ mode. Corresponding waveguide mode patterns depicted by solid line 84 shows the $H_{11}$ mode along the XZ plane and dashed and dotted line 86 shows the $H_{11}$ mode along the XY plane. A comparison of FIG. 5A and FIG. 6A demonstrates that substantial modification of antenna dimensions as shown in respective configuration shown in FIG. 5 and FIG. 6 has minimal impact on the antenna performance—XZ plane peak gain @ angle=delta<ldB. Such dimensional conformability of the present waveguide antenna manifests in diverse space allocations and applications, and is particularly advantageous in compact electronic device package redesigns contexts. The present waveguide antenna's stable performance notwithstanding packaging revisions while maintaining provides a substantial advantage of the present waveguide antenna over existing designs wherein package reconfiguration typically requires complete redesign of supporting antenna(s).

While a number of exemplary aspects and embodiments have been discussed above, those possessed of skill in the art will recognize certain modifications, permutations, additions and sub-combinations thereof. In particular, this invention embraces waveguides of any shape and size, regardless of symmetry or geometric regularity, wherein dynamic positioning of an aperture in correspondence with a resonant back short and excitation points configured to provide nonevanescent waveguide modes described and claimed herein. Such waveguides are not limited to a coaxial configuration but may comprise any number or combination of conductive layers and resonant cavities. It is therefore intended that the scope of this specification include all such modifications, permutations, additions and sub-combinations as are within their true spirit and scope.

What is claimed is:

1. A waveguide antenna assembly for transceiving signals of a predetermined radio frequency range to and from an electronic device supported thereby, comprising:

a first conductive layer configured in a conformable loop, wherein the first conductive layer has an inner surface and an outer surface, the inner surface and outer surface having an area coextensively disposed between an outer edge and an opposing inner edge;

a second conductive layer configured in a conformable loop, having of an area coextensively disposed between an outer edge and an opposing inner edge, wherein the second conductive layer is collaterally aligned with the inner surface of the first conductive layer so as to electrically isolate the second conductive layer from the first conductive layer for support of waveguide modes corresponding to the signals of the predetermined frequency range;

an electrically isolating channel extending between the inner surface of the first conductive layer and the second conductive layer, wherein the electrically isolating channel is dimensionally configured for transmission of the waveguide modes corresponding to the signals of the predetermined frequency range;

an aperture for electromagnetically transceiving the signals of a predetermined radio frequency range, wherein the aperture is oriented along a surface of the electrically isolating channel such that the aperture is disposed between the outer edge of the inner surface of the first conductive layer and the second conductive layer;

a back short spaced back from the aperture a predetermined distance equal to a resonant length of the waveguide mode wavelength, wherein the back short provides a circuit impedance between the first conductive layer and the second conductive layer for tuning the waveguide for transceiving the signals of a predetermined frequency range;

at least one excitation point coupled to the aperture, wherein the at least one excitation point couples the signals of a predetermined frequency range so as to propagate the waveguide modes within the electrically isolating channel; and an electrical feed of the signals of a predetermined frequency range to and from an electronic device.

2. The waveguide antenna assembly of claim 1, wherein the at least one excitation point further comprises quadrature excitation points oriented in orthogonal correspondence to the waveguide so as to propagate waveguide modes within the electrically isolating channel.

3. The waveguide antenna assembly of claim 1, wherein the at least one excitation point further comprises excitation points oriented so as to sequentially electromagnetically shift the phase of the signals of a predetermined frequency range to cause rotational polarization of the waveguide modes.

4. The waveguide antenna assembly of claim 1, wherein the at least one excitation point is amplitude and phase coupled so as to switch the waveguide modes of the radio frequency signals of a predetermined wavelength to thereby steer antenna gain thereof.

5. The waveguide antenna assembly of claim 1, wherein the at least one excitation point further comprises quadrature excitation points configured to sequentially electromagnetically shift the phase of the signals of a predetermined frequency range to cause rotational polarization of the waveguide modes.

6. The waveguide antenna assembly of claim 1, wherein the back short sets a reference point in the electrically isolating channel such that mode fields are stable along the waveguide propagation direction.

7. The waveguide antenna system of claim 1, wherein the back short is adjustably mounted for providing a circuit impedance in the range of between one-eighth and one-half of a waveguide mode wavelength of the corresponding signals of the predetermined radio frequency range.

8. The waveguide antenna system of claim 1, wherein the back short is spaced back from the aperture one-quarter of a waveguide mode wavelength of the corresponding signals of the predetermined radio frequency range.

9. The waveguide antenna system of claim 1, wherein the inner conductive layer and the outer conductive layer are dimensionally configured to support a nonevanescent waveguide mode, and wherein the back short is spaced apart from the aperture a resonant length of the nonevanescent waveguide mode wavelength of the signals of the predetermined radio frequency range.

10. The waveguide antenna assembly of claim 1, wherein the signals of the predetermined radio frequency range comprise between 1 Hz and 1 THz.

11. The waveguide antenna assembly of claim 1, wherein the electronic device is installed within the inner conductive layer such that the electronic device is enclosed within the waveguide antenna assembly.

12. The waveguide antenna assembly of claim 1, further comprising enclosure thereof within a nonconductive material extending about the electronic device supported thereby.

13. The waveguide antenna assembly of claim 1, further comprising embedding thereof in a nonconductive material extending about the electronic device supported thereby.

14. The waveguide antenna assembly of claim 1, wherein the electronic device comprises a processor-based system.

15. The waveguide antenna assembly of claim 1, wherein the electronic device enables transceiving digitally streamed and broadcasted signals.

* * * * *